US007171830B2

(12) United States Patent
Taljaard et al.

(10) Patent No.: US 7,171,830 B2
(45) Date of Patent: Feb. 6, 2007

(54) MONITORING OF OPERATION OF A PADLOCK

(75) Inventors: Petrus Arnoldus Taljaard, Plot 233, Mooiplaas, Pretoria (ZA) 5288; Gerrit Johann Visagie, Pretoria (ZA)

(73) Assignee: Petrus Arnoldus Taljaard (ZA)

( * ) Notice: Subject to any disclaimer, the term of this patent is extended or adjusted under 35 U.S.C. 154(b) by 0 days.

(21) Appl. No.: 10/512,267

(22) PCT Filed: Apr. 22, 2003

(86) PCT No.: PCT/IB03/01484

§ 371 (c)(1),
(2), (4) Date: Mar. 16, 2005

(87) PCT Pub. No.: WO03/091519

PCT Pub. Date: Nov. 6, 2003

(65) Prior Publication Data

US 2005/0155396 A1 Jul. 21, 2005

(30) Foreign Application Priority Data

Apr. 23, 2002 (ZA) ..... 2002/3223
Jul. 10, 2002 (ZA) ..... 2002/5520

(51) Int. Cl.
*E05B 67/38* (2006.01)

(52) U.S. Cl. ..... 70/50; 70/52; 70/56; 70/422; 70/424; 70/428; 70/432; 70/455

(58) Field of Classification Search ..... 70/50–52, 70/54–56, 423, 424, 427, 428, 455, 422, 70/429–432, 439–441, DIG. 43, DIG. 56, 70/DIG. 59
See application file for complete search history.

(56) References Cited

U.S. PATENT DOCUMENTS

| | | | | | |
|---|---|---|---|---|---|
| 104,441 | A * | 6/1870 | Gale | 70/50 |
| 607,807 | A * | 7/1898 | St. John | 70/430 |
| 674,776 | A * | 5/1901 | Kraemer | 70/430 |
| 804,093 | A * | 11/1905 | Breniman | 70/429 |
| 858,264 | A * | 6/1907 | Daugherty | 292/307 A |
| 1,460,472 | A * | 7/1923 | Benson | 70/50 |
| 2,159,305 | A * | 5/1939 | White | 70/430 |
| 2,666,318 | A | 1/1954 | Welch | |
| 3,863,468 | A * | 2/1975 | Bach | 70/50 |
| 5,219,194 | A * | 6/1993 | Trent et al. | 292/307 R |
| 2002/0116796 | A1* | 8/2002 | Wills | 24/306 |
| 2005/0210932 | A1* | 9/2005 | Azzalin et al. | 70/51 |

* cited by examiner

*Primary Examiner*—Lloyd A. Gall
(74) *Attorney, Agent, or Firm*—Welsh & Katz, Ltd.

(57) ABSTRACT

A telltale device (10), securable to a padlock (18) having a key-operated release mechanism, includes a seal (12) to seal a key (20) for the padlock (18) in a lock position in the padlock release mechanism such that removing the key (20) or operating the key (20) to open the padlock (18) damages or destroys the seal (12).

13 Claims, 1 Drawing Sheet

MONITORING OF OPERATION OF A PADLOCK

Figure 1:
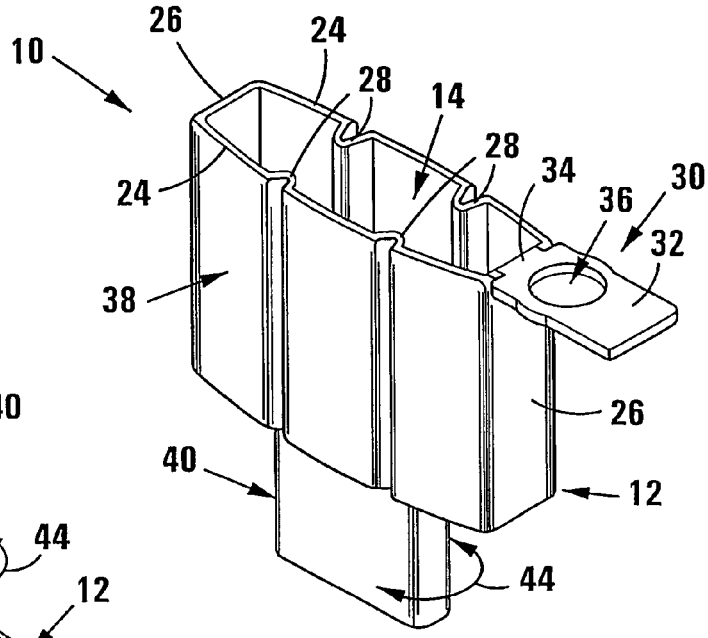

This application is the national stage of International Application No. PCT/IB03/01484 filed Apr. 22, 2003.

THIS INVENTION relates to the monitoring of operation of a padlock. In particular, it relates to a method of locking an item and to a telltale device securable to a padlock having a key-operated release mechanism.

According to one aspect of the invention, there is provided a method of locking an item, the method including locking the item with a padlock having a key-operated release mechanism; and sealing a key for the padlock to the padlock with a telltale device, the key being in a lock position in the padlock release mechanism, so that removing the key or operating the key to open the padlock damages or destroys the telltale device.

In this specification, the term "padlock" is intended to include key-operated locks similar to padlocks having shackles, bolts, toothed racks or the like at least a portion of which is external to a lock body and which is lockable in position relative to the lock body. The key may be removably or permanently mounted to the lock.

Sealing the key for the padlock to the padlock with a telltale device may include covering the key of the padlock with the telltale device, which may be of a transparent or translucent material. Sealing the key for the padlock to the padlock with a telltale device may further include covering at least a portion of a body of the padlock with the telltale device. Preferably, this is effected without visually obstructing an identification feature of the padlock, if the padlock includes an identification feature, e.g. an identification number.

Covering the key of the padlock with the telltale device may include inserting the padlock, unlocked, with the key in a lock position in the padlock release mechanism, key first into an open end of a jacket forming part of the telltale device.

The method may include attaching the telltale device to the padlock by passing a shackle, bolt, toothed rack, or the like of the padlock through a portion of the telltale device, before locking the item with the padlock.

According to another aspect of the invention, there is provided a telltale device, securable to a padlock having a key-operated release mechanism, the telltale device including seal means to seal a key for the padlock in a lock position in the padlock release mechanism such that removing the key or operating the key to open the padlock damages or destroys the seal means.

The seal means may be in the form of a cover body, which includes a jacket defining a cavity for receiving at least the key of a padlock which is in a lock position in the padlock. Preferably, the jacket defines a cavity or cavities for snugly receiving the key and a padlock body of the padlock, the jacket having an open end through which the padlock, with the key in the padlock release mechanism, can be inserted key first. At least a portion of the jacket may be of a transparent or translucent material to allow visual confirmation of the presence of the key in the padlock release mechanism.

At least a portion of the telltale device may be of a material which includes a phosphorescent constituent.

The telltale device may include securing means for securing the jacket to the padlock. The securing means may be provided by a securing member, fast with the jacket and having an opening which in use can be positioned to receive the shackle, bolt, toothed rack, or the like. The securing member may be in the form of a tab hingedly connected to the jacket and defining the opening which in use can be positioned to receive the shackle, bolt, toothed rack, or the like.

Instead, the securing means may be in the form of at least one aperture in the jacket for receiving a shackle, bolt, toothed rack, or the like of the padlock.

According to another aspect of the invention, there is provided a telltale device, securable to a padlock having a key-operated release mechanism, the device including a cover body mountable to the padlock such that at least a portion thereof covers a key for the padlock which is in a lock position in the padlock release mechanism; and securing means for securing the cover body to the padlock so that the cover body must be visibly damaged or destroyed in order to remove the key or to operate the key to open the padlock.

A portion of the cover body may be configured to cover at least a portion of a body of the padlock.

The cover body may define an aperture or window or may include a transparent wall, through which an identification feature of the padlock will be visible in use, as described in PCT/IB02/00191, the specification of which is incorporated herein by way of reference. Furthermore, the cover body, or a portion thereof, may be of a transparent or translucent material to allow visual confirmation of the presence of the key in the padlock release mechanism. The telltale device or a portion thereof may be of a material which includes a phosphorescent constituent.

The telltale device may include indicating means for indicating removal or operation of the key of the padlock.

The indicating means may include a frangible zone in the cover body, between the portion of the cover body configured to cover the key and the portion of the cover body configured to cover at least a portion of the padlock body.

The cover body may include a series of peripherally spaced longitudinally extending ribs which protrude inwardly from an inner surface of the cover body and which are adapted in use to bear against the padlock body and to limit the angular displacement of the padlock body in the cover body. The ribs may also serve to strengthen the cover body.

The telltale device may include indicia which are formed on an external surface of the device. The indicia may be printed, indelibly embossed or stamped onto the surface of the cover body. The indicia may function as an identification feature for the telltale device. Preferably, when the cover body includes a window or aperture, the indicia is provided on a portion of the cover body which includes the window or aperture.

The cover body may include a jacket as hereinbefore described. Thus, the jacket may define a cavity or cavities for snugly receiving the key of a padlock which is in a locked position and the padlock body of the padlock, the jacket having an open end through which the key and padlock can be inserted.

The securing means may be as hereinbefore described.

The telltale device may be in the form of a unitary moulding of synthetic plastics material.

Figure 2:
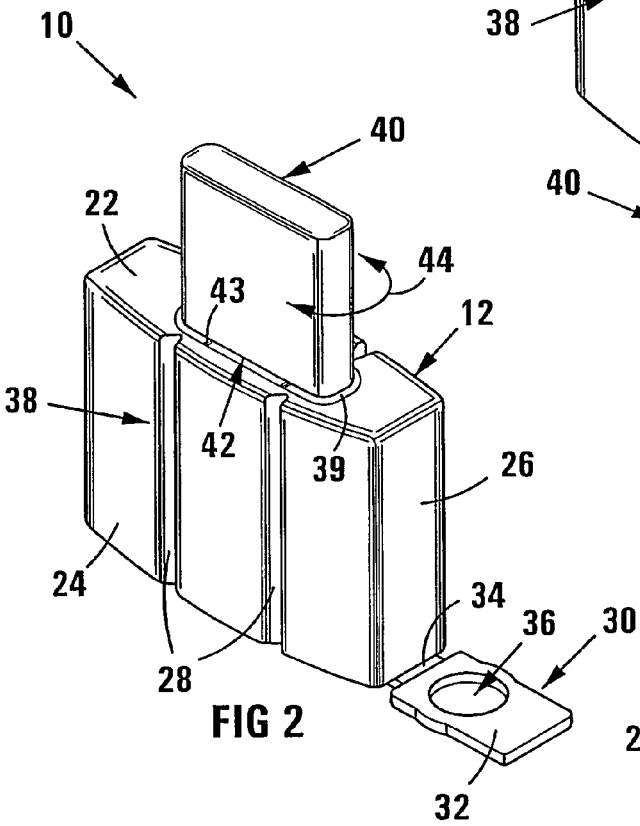
Figure 3:
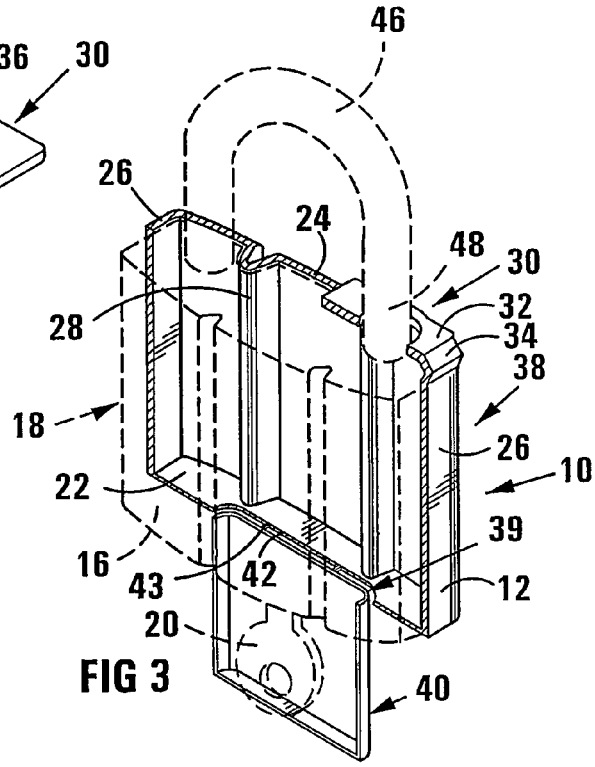

The invention will now be described, by way of example, with reference to the accompanying diagrammatic drawings in which FIG. 1 shows a perspective top view of a telltale device in accordance with the invention;

FIG. 2 shows a perspective bottom view of the telltale device of FIG. 1; and FIG. 3 shows a sectioned perspective view of the telltale device of FIG. 1, corresponding to FIG. 1, in use.

Referring to the drawings, reference numeral 10 refers generally to a telltale device in accordance with the invention. The telltale device 10 includes a cover body, in the form of a jacket 12, which defines a cavity 14 within which a body 16 of a padlock 18 having a shackle 46, as well as a key 20 for the padlock 18 is receivable (see FIG. 3).

The jacket 12 includes a bottom wall 22 which is roughly rectangular when viewed in plan. Transversely spaced longitudinal walls 24 and longitudinally spaced transverse walls 26 extend respectively from the long and short edges of the bottom wall 22.

Two transversely spaced longitudinally extending ribs 28 protrude inwardly from an inner surface of each of the longitudinal walls 24.

The telltale device 10 includes securing means, generally indicated by reference numeral 30 whereby the telltale device 10 is lockable to the padlock 18. The securing means 30 includes a flap or tab 32 which is connected to a free edge of one of the transverse walls 26 by a hinge 34. A hole 36 extends through the tab 32.

The jacket 12 comprises two portions. A first portion of the jacket 12, generally indicated by reference numeral 38, is configured to receive the body 16 of the padlock 18. It is also this portion 38 of the jacket 12 which carries the ribs 28.

The jacket 12 also includes a portion 40 for in use covering the key 20 of the padlock 18. The portion 40 is roughly cigarette-box shaped. An interior of the portion 40 is in communication with an interior of the portion 38, via an aperture 39 (see FIG. 3) in the bottom wall 22.

Indicating means, in the form of a frangible zone 42 connects the portions 38, 40 of the jacket 12 to each other. The frangible zone 42 comprises a plurality of bridging formations 43 connecting the portions 38, 40 of the jacket 12. If desired, the bridging formations 43 may be slanted and enlarged (not shown), to facilitate inspection of the device 10.

The telltale device 10 is in the form of a unitary moulding of a synthetic plastics material, e.g. polypropylene, which includes a phosphorescent constituent, allowing the telltale device 10 to glow in the dark. Instead, the telltale device 10 may include phosphorescent markings. Although not shown in the drawings, in a preferred embodiment of the telltale device of the invention, at least the portion 40 of the jacket 12 is translucent to allow easy visual confirmation of the presence of the key 20 in a padlock release mechanism of the padlock 18. Typically, the synthetic plastics material will be between 0.5 mm and 1.5 mm in thickness so as to permit easy tearing of the bridging formations 43 of the frangible zone 42 by hand, when the portion 40 of the jacket 12 is twisted as indicated by arrow 44.

Indicia such as logos and/or other trade marks may be formed on the jacket 12. Preferably, serial numbers (not shown) are provided on one of the longitudinal walls 24. It is also to be noted that an aperture may be provided in one of the walls 24, 26 of the jacket 12, typically in one of the longitudinal walls 24, as described in PCT/IB02/00191, to allow visual confirmation of any identification feature, such as an ID number, applied to the body 16 of the padlock 18.

The telltale device 10 is particularly suitable for use with padlocks which are normally kept in a locked condition, but which it is desired should be quickly and easily unlockable, e.g. in the event of an emergency. A typical example of such a padlock is a padlock used on an emergency or fire escape door.

In use, an unlocked padlock 18, with the key 20 in the padlock release mechanism, is inserted key first into the cavity 14 until the key 20 is located in the portion 40 of the jacket 12 and the body 16 of the padlock 18 is snugly received inside the portion 38 of the jacket 12. This situation is clearly illustrated in FIG. 3 of the drawings. The tab 32 is then bent over so that the hole 36 therein is in register with an open hole in an upper surface of the body 16 of the padlock 18 and the padlock 18 is locked in position by closing the shackle 46 such that a limb 48 of the shackle 46 extends through the hole 36 in the tab 32, as shown in FIG. 3 of the drawings.

The ribs 28 abut against the surface of the body 16 to ensure a snug fit and in order to resist relative displacement of the padlock body 16 in the cavity 14. If desired, the padlock body 16 may be provided with complementary recesses within which the ribs 28 engage thereby further resisting relative displacement.

The portion 40 of the jacket 12 forms a cover for the key 20 thereby denying direct access to the key 20. However, the padlock 18 can easily be unlocked by gripping the portion 40 of the jacket 12 between the fingers of a person, and twisting the portion 40, and the key 20, as indicated by the arrow 44. When the portion 40 is twisted, the bridging formations 43 of the frangible zone 42 tear separating the portion 40 from the portion 38, thereby leaving clear evidence that the padlock 18 was opened.

By virtue of the fact that the only way to gain access to the padlock 18 once the telltale device 10 is mounted thereon is by visibly damaging or destroying the device 10, it serves as a ready indicator to indicate if unauthorised access has been gained to the padlock 18. Furthermore, when the portion 40 of the jacket 12 is of a transparent material, it is easy to check whether or not a key is in position in the release mechanism of the padlock 18. This is of particular importance in the case of padlocks used on emergency and fire escape doors or the like.

The telltale device 10, as illustrated, provides a ready and relatively inexpensive seal for sealing a key in a lock position inside a release mechanism of a padlock, and provides a ready and relatively inexpensive indication as to whether there has been unauthorised tampering with a padlock. In addition, each device can be provided with a serial number and/or a logo and/or could be colour-coded permitting easy identification, traceability and control. Furthermore, the inventor believes that the device will be relatively easy to use. Advantageously, the device 10 may provide phosphorescence, allowing the device 10 to be easily seen in the dark, e.g. in an emergency door stairwell or area which is dark in the event of a power failure. Lastly, in view of the fact that almost the entire body of the padlock, as well as the key of the padlock, is enclosed by the jacket 12 of the device 10, the device 10 also serves to inhibit the ingress of foreign matter into the mechanisms of the padlock.

The invention claim is:

1. A method of locking an item, the method including locking the item with a padlock having a key-operated release mechanism; and sealing a key for the padlock to the padlock with a telltale device, the key being in a lock position in the padlock release mechanism, so that removing the key or operating the key to open the padlock damages or destroys the telltale device, sealing the key for the padlock to the padlock with the telltale device including covering the key of the padlock with the telltale device and covering at least a portion of a body of the padlock with the telltale device, covering the key of the padlock with the telltale device including inserting the padlock, unlocked, with the key in a lock position in the padlock release mechanism, key first into an open end of a jacket forming part of the telltale device.

2. The method as claimed in claim 1 in which at least a portion of the telltale device is of a material which includes a phosphorescent constituent.

3. The method as claimed in claim 1, which includes attaching the telltale device to the padlock by passing a shackle, bolt or toothed rack of the padlock through an aperture in a portion of the telltale device, before locking the item with the padlock.

4. A telltale device, securable to a padlock having a key-operated release mechanism, the telltale device including seal means to seal a key for the padlock in a lock position in the padlock release mechanism such that removing the key or operating the key to open the padlock damages or destroys the seal means, the seal means being in the form of a cover body which includes a jacket defining a cavity for receiving at least the key of a padlock which is in a lock position in the padlock, and the jacket defining a cavity or cavities for snugly receiving the key and a padlock body of the padlock, the jacket having an open end through which the padlock, with the key in the padlock release mechanism, can be inserted key first.

5. The telltale device as claimed in claim 4, in which at least a portion of the jacket is of a transparent or translucent material to allow visual confirmation of the presence of the key in the padlock release mechanism.

6. The telltale device as claimed in claim 4, in which at least a portion thereof is of a material which includes a phosphorescent constituent.

7. The telltale device as claimed in claim 4, which includes securing means for securing the jacket to the padlock.

8. The telltale device as claimed in claim 7, in which the securing means is provided by a securing member, fast with the jacket and having an opening which in use can be positioned to receive a shackle, bolt or toothed rack of the padlock.

9. The telltale device as claimed in claim 7, in which the securing means is in the form of at least one aperture in the jacket for receiving a shackle, bolt or toothed rack of the padlock.

10. The telltale device as claimed in claim 4, which includes indicating means for indicating removal or operation of the key of the padlock.

11. The telltale device as claimed in claim 10, in which the indicating means includes a frangible zone in the cover body, between a portion of the cover body configured to receive the key and a portion of the cover body configured to receive the padlock body.

12. A method of locking an item, the method including locking the item with a padlock having a key-operated release mechanism; and sealing a key for the padlock to the padlock with a telltale device, the key being in a lock position in the padlock release mechanism, so that removing the key or operating the key to open the padlock damages or destroys the telltale device, sealing the key for the padlock to the padlock with the telltale device including covering a portion of the key of the padlock external of the padlock with the telltale device and covering at least a portion of a body of the padlock with the telltale device.

13. A telltale device, securable to a padlock having a key-operated release mechanism, the telltale device including seal means to seal a key for the padlock in a lock position in the padlock release mechanism such that removing the key or operating the key to open the padlock damages or destroys the seal means, the seal means being in the form of a cover body which includes a jacket defining a cavity for receiving at least an external portion of the key of a padlock which is in a lock position in the padlock.

* * * * *